US006881121B1

(12) United States Patent
Szekely

(10) Patent No.: US 6,881,121 B1
(45) Date of Patent: Apr. 19, 2005

(54) INJECTION MOLDED NOISE-MAKER

(76) Inventor: Michael Szekely, 5801 NW. 31st St., Oklahoma City, OK (US) 73122

( * ) Notice: Subject to any disclaimer, the term of this patent is extended or adjusted under 35 U.S.C. 154(b) by 164 days.

(21) Appl. No.: 10/630,133

(22) Filed: Jul. 30, 2003

(51) Int. Cl.[7] ..... A63H 5/00
(52) U.S. Cl. ..... 446/213; 446/397
(58) Field of Search ..... 84/330; 446/397, 446/176, 180, 188, 202, 204, 205, 206, 213, 216

(56) References Cited

U.S. PATENT DOCUMENTS 4,116,108 A * 9/1978 Hyman ..... 84/330
5,234,368 A * 8/1993 Carraway ..... 446/202
6,386,938 B1 * 5/2002 Novak et al. ..... 446/186

* cited by examiner

*Primary Examiner*—Jacob K. Ackun, Jr.
(74) *Attorney, Agent, or Firm*—Capehart Law Firm; Brent A. Capehart

(57) ABSTRACT

The invention provides a noise-maker having an injection molded single piece body, a membrane and a retaining ring. The injection molded single piece body includes a generally cylindrical central tube and a generally cylindrical pressure tube which defines a pressure chamber. The retaining ring has an inner diameter adapted to fit over the outer surface of said pressure tube such that the membrane is secured to and stretched across the central tube first end and the pressure tube first end. Sound is created when air or other gas is forced into pressure chamber. The air must pass through the pressure chamber around a central tube first end and out the discharge end of a sound extension end. By forcing air into the pressure chamber, membrane vibrates producing a loud sound.

7 Claims, 2 Drawing Sheets

INJECTION MOLDED NOISE-MAKER

REFERENCE TO PENDING APPLICATIONS

This application is not based upon any pending domestic or international patent applications.

REFERENCE TO MICROFICHE APPENDIX

This application is not referenced in any microfiche appendix.

FIELD OF THE INVENTION

The present invention is generally directed toward the production of a noise-maker, more particularly the production of noisemaker by an injection-mold process.

BACKGROUND OF THE INVENTION

Organized team sports, including football, basketball, baseball, and soccer, have a significant role in modern culture, and sporting events are attended by millions of people each year. Fans who attend sporting events typically do so not just as passive observers, but as participants in the sense of cheering for and encouraging their chosen teams. In addition to verbal cheers and applause, many fans use noise making devices to express their excitement and encouragement. It is generally considered that coordinated cheers are particularly effective for encouraging the players and encouraging other fans.

Many fans wish to express their support and encourage their chosen teams with noisemakers of one form or another. While prior art devices do produce noises, the sounds are poorly projected toward the field and can typically lack aesthetic qualities.

While many noise-makers have been made in recent years, these noise-makers typically have drawbacks involving the cost of manufacture. These noise-makers are made from the combination of numerous parts, causing an increased cost thereof. Accordingly, such noise-makers have not been considered economical to manufacture.

Thus, there is a need to create an aesthetically pleasing but cost efficient noisemaker which can produce a desired level of sound.

BRIEF SUMMARY OF THE INVENTION

The present invention satisfies the need discussed above. The present invention is generally directed toward the production of a noise-maker, more particularly the production of noisemaker by an injection-mold process.

The invention provides for a single injection molded structural body for use with a noisemaker. In contrast to multi-component prior art noise-makers, a noise-maker body of the invention is easily injection molded in a single manufacturing step, which provides inherent quality control for size and configuration Thus, the component provides substantial savings in manufacturing steps and labor and is economical to manufacture.

In one aspect, the present invention provides a noise-maker having an injection molded single piece body, a membrane and a retaining ring. The injection molded single piece body includes a generally cylindrical central tube and a generally cylindrical pressure tube. The generally cylindrical central tube has a central tube first end and a central tube second end and defining a sound chamber. A sound extension tube is integrally formed with the central tube and has a discharge end.

The generally cylindrical pressure tube has a pressure tube first end and pressure tube second end and being disposed about said generally cylindrical central tube to define a pressure chamber. The pressure tube further has a generally cylindrical portion having sound a cylindrical portion end which tapers radially inward to define a tapered bottom. The tapered bottom is connected to and integral with the central tube second end. A sound hole is defined through the pressure tube.

The membrane extends over the central tube first end and the pressure tube first end, and is made from thin material, such as but not limited to cellophane.

The retaining ring has an inner diameter adapted to fit over the outer surface of said pressure tube such that the membrane is secured to and stretched across the central tube first end and the pressure tube first end.

Sound is created when air or other gas is forced into pressure chamber. The air must pass through the pressure chamber around central tube first end and out the discharge end of the sound extension end. By forcing air through the sound hole and into the pressure chamber, membrane vibrates producing a loud sound.

Another aspect of the present invention provides for the noise-maker of the present invention where the axial length of the pressure chamber is less than the axial length of the sound chamber. This allows for pressure to build up more quickly in the pressure chamber so that the vibration of the membrane can occur more easily.

Another aspect of the present invention provides for the noise-maker set out above where the central tube first end lies in generally same plane as the pressure tube first end.

In yet another aspect of the present invention, the noise-maker set out above where the central tube first end lies in a first plane and the pressure tube first end lies in a second plane is disclosed. The distance between the first plane and the second plane is defined by a setback, which can range from between 0.01 mm and 0.5 mm, with 0.18 mm preferably.

To adjust the pitch of the sound of the present invention, extenders can be attached to the discharge end of said sound extension tube.

Further features of the present invention will be apparent to those skilled in the art upon reference to the accompanying drawings and upon reading the following description of the preferred embodiments.

DETAILED DESCRIPTION OF THE PREFERRED EMBODIMENTS

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation.

Figure 1:
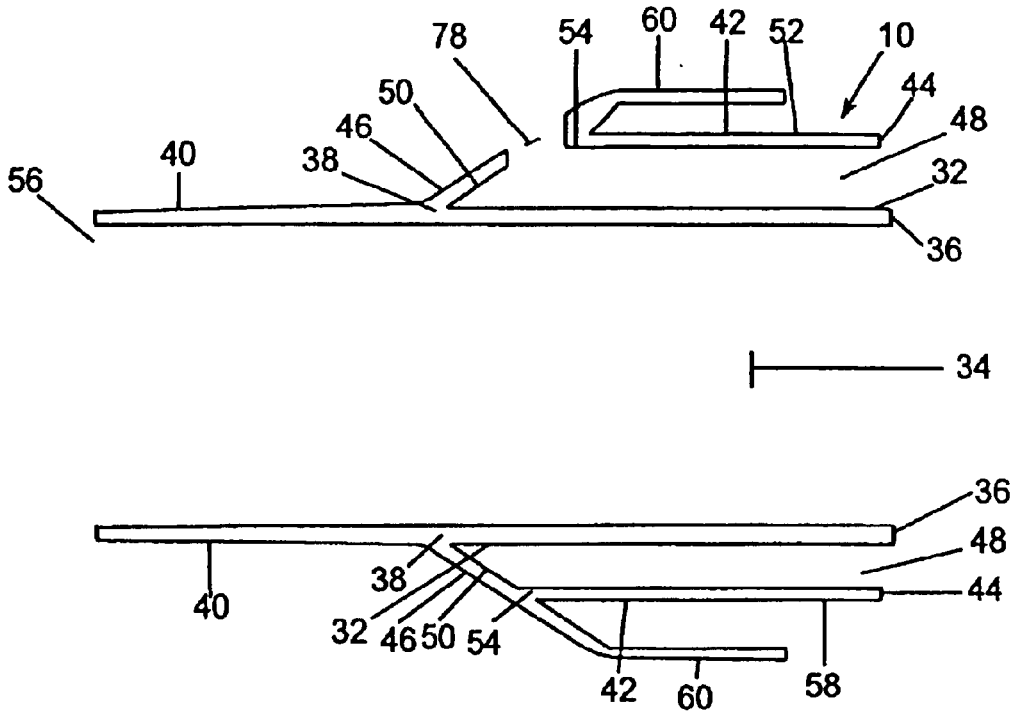
FIG. 1 is a cross-section side view of an embodiment of the body section of the present invention.
Figure 2:
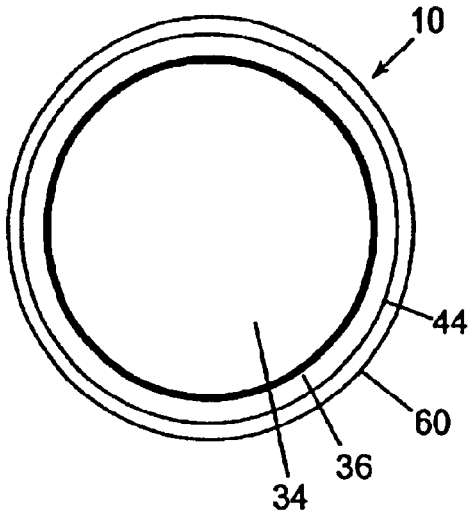
FIG. 2 is a top view of the embodiment of FIG. 1.
Figure 3:
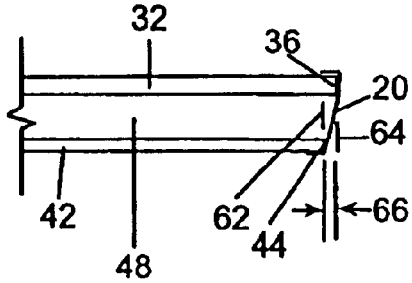
FIG. 3 is a cross-section view of an embodiment of the pressure tube first end and central tube first end of the present invention.
Figure 4:
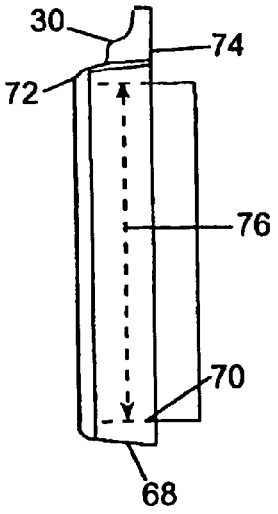
FIG. 4 is a cross-section view of an embodiment of the retaining ring of the present invention.
Figure 5:
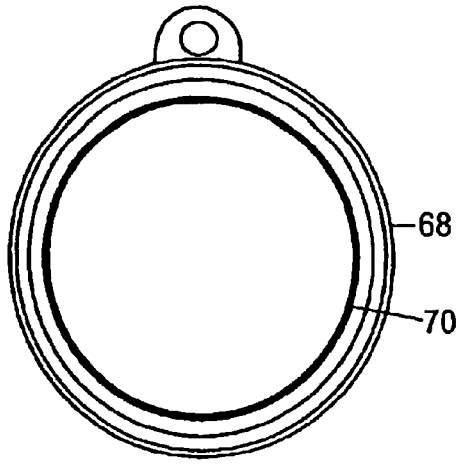
FIG. 5 is a top view of the embodiment of FIG. 4.
Figure 6:
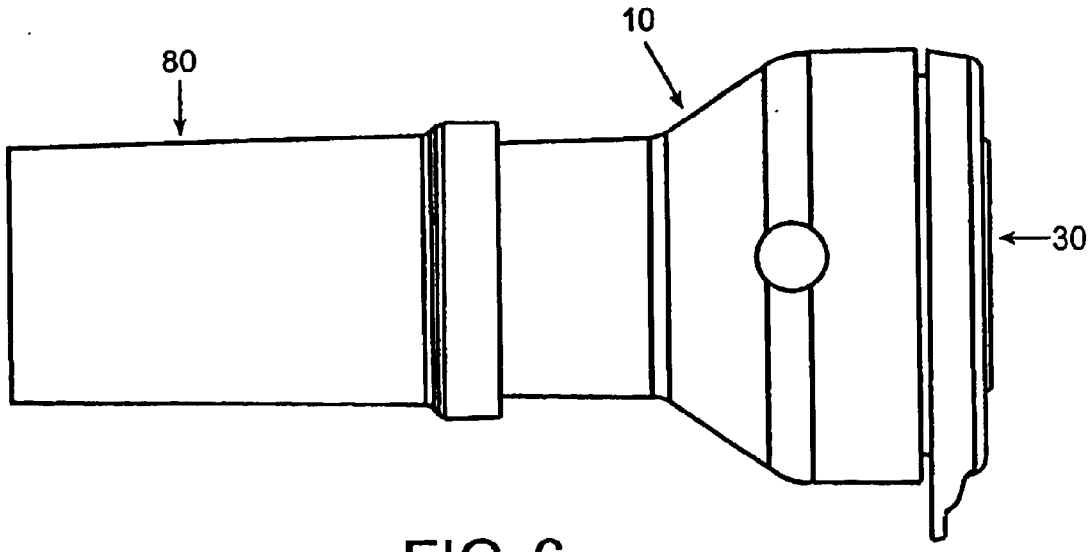
FIG. 6 is a perspective view of an embodiment of the present invention having an embodiment of an extender attached thereto.

As shown in FIG. 1, an embodiment of the inventive noise-maker is disclosed. The embodiment comprises a single injection molded structural body 10, a membrane 20 and a retaining ring 30. The injection molded single piece body 10 includes a generally cylindrical central tube 32 and a generally cylindrical pressure tube 42. The generally cylindrical central tube 32 has a central tube first end 36 and a central tube second end 38 and defining a sound chamber 34. A sound extension tube 40 is integrally formed with the generally cylindrical central tube 42 and has a discharge end 56.

The generally cylindrical pressure tube 42 has a pressure tube first end 44 and pressure tube second end 46 and being disposed about said generally cylindrical central tube 32 to define a pressure chamber 48. The generally cylindrical pressure tube 42 further has a generally cylindrical portion 52 having a cylindrical portion end 54 which tapers radially inward to define a tapered bottom 50. The tapered bottom 50 is connected to and integral with the central tube second end 38.

A sound hole 78 is defined through the pressure tube 42. The membrane 20 extends over the central tube first end 36 and the pressure tube first end 44, and is made from thin material, such as but not limited to cellophane.

The retaining ring 30 has an inner diameter 76 adapted to fit over the outer surface 58 of said generally cylindrical pressure tube 44 such that the membrane 20 is secured to and stretched across the central tube first end 36 and the pressure tube first end 44.

Sound is created when air or other gas is forced into pressure chamber 48. The air must pass through the pressure chamber 48 around central tube first end 36 and out the discharge end 56 of the sound extension end 40. By forcing air through sound hole 78 and into the pressure chamber 48, membrane 20 vibrates producing a loud sound.

Another aspect of the present invention provides for the noise-maker set out above where the central tube first end 36 lies in generally same plane as the pressure tube first end 44.

In yet another aspect of the present invention, the noise-maker set out above where the central tube first end 36 lies in a first plane 64 and the pressure tube first end 44 lies in a second plane 62 is disclosed. The distance between the first plane 64 and the second plane 62 is defined by a setback 66, which can range from between 0.01 mm and 0.5 mm, with 0.18 mm preferably.

To adjust the pitch of the sound of the present invention, extenders 80 can be attached to the discharge end of said sound extension tube.

While the invention has been described with a certain degree of particularity, it is understood that the invention is not limited to the embodiments set forth herein for purposes of exemplification, but is to be limited only by the scope of the attached claims or including the full range of equivalency to which each element thereof is entitled.

What is claimed is:

1. A noise-maker comprising:

an injection molded single piece body including a generally cylindrical central tube and a generally cylindrical pressure tube, said generally cylindrical central tube having a central tube first end and a central tube second end and defining a sound chamber, said generally cylindrical central tube includes a sound extension tube integrally formed with said central tube second end, said sound extension tube having a discharge end, said generally cylindrical pressure tube having a pressure tube first end and pressure tube second end and being disposed about said generally cylindrical central tube to define a pressure chamber, said pressure tube further having a generally cylindrical portion having sound a cylindrical portion end which tapers radially inward to define a tapered bottom, said tapered bottom being connected to and integral with said central tube second end, said generally cylindrical pressure tube defines a sound hole such that air or other gas may be forced into said pressure chamber;

a membrane extending over said central tube first end and said generally cylindrical pressure tube first end; and a retaining ring having an inner diameter adapted to fit over said outer surface of said generally cylindrical pressure tube such that said membrane is secured to and stretched across said central tube first end and said pressure tube first end.

2. The noise-maker of claim 1 wherein said central tube first end lies in generally same plane as said pressure tube first end.

3. The noise-maker of claim 1 wherein said central tube first end lies in a first plane and said pressure tube first end lies in a second plane, the distance between said first plane and said second plane defines a setback.

4. The noise-maker of claim 3 wherein said setback ranges between 0.01 mm and 0.2 mm.

5. The noise-maker of claim 1 further comprising one or more extenders removably connected to said discharge end of said sound extension tube.

6. The noise-maker of claim 1 wherein the axial length of said pressure chamber is less than the axial length of said sound chamber.

7. The noise-maker of claim 1 wherein said membrane is made from cellophane.

* * * * *